United States Patent [19]

Flavel

[11] 4,179,074

[45] Dec. 18, 1979

[54] METHOD OF CONTROLLING FEED RATE TO CRUSHING PLANT WHILE CRUSHERS ARE ADJUSTED TO CONTINUALLY OPERATE AT FULL POWER

[75] Inventor: Malcolm D. Flavel, Appleton, Wis.

[73] Assignee: Allis-Chalmers Corporation, Milwaukee, Wis.

[21] Appl. No.: 938,259

[22] Filed: Aug. 30, 1978

[51] Int. Cl.[2] ..... B02C 23/00

[52] U.S. Cl. ..... 241/24; 241/34; 241/36; 241/37

[58] Field of Search ..... 241/24, 29, 30, 33, 241/34, 36, 37

[56] References Cited

U.S. PATENT DOCUMENTS

| | | | |
|---|---|---|---|
| 3,480,212 | 11/1969 | Liljegren et al. | 241/34 |
| 3,779,469 | 12/1973 | Putman | 241/34 X |
| 3,783,252 | 1/1974 | Putman | 241/34 X |

FOREIGN PATENT DOCUMENTS

| | | | |
|---|---|---|---|
| 750535 | 6/1956 | United Kingdom | 241/34 |

*Primary Examiner*—Richard B. Lazarus

*Attorney, Agent, or Firm*—Arthur M. Streich

[57] ABSTRACT

For control of a crushing plant to ensure both that a quota quantity of product is produced during each working period and that the product has optimum economic value by reason of small particle size, determination is made of the amount of product passed through the plant from the beginning of the period to each of a number of measurement times during the period. Each such determination gives a "still to go" quantity, hence a theoretical new feed rate to be maintained. The rate of feed of material into the plant is adjusted in correspondence with the ratio between that theoretical rate and the actual feed rate prevailing during an interval just before the measurement time. The crushing mechanism is controlled constantly to draw the full power available to it while it maintains output substantially in step with prevailing feed rate, such control being effected by adjusting crusher setting, apportioning feed material between crushers and/or controlling the relative portions of output material from a crusher that are respectively recirculated through that crusher and transferred elsewhere.

11 Claims, 6 Drawing Figures

METHOD OF CONTROLLING FEED RATE TO CRUSHING PLANT WHILE CRUSHERS ARE ADJUSTED TO CONTINUALLY OPERATE AT FULL POWER

TECHNICAL FIELD

This invention relates generally to a method of so controlling the operation of a mineral crushing plant that its available power is employed to obtain a product having optimum economic value; and the invention is more particularly concerned with a method of controlling a plant for crushing iron ore or the like to enable the power available for the plant to be so utilized that a required production quota will be met at the end of each work day or other working period and the crushed product obtained from operations during the working period will have optimum economic value by reason of its fineness.

BACKGROUND OF PRIOR ART

The present invention is concerned with the power economy of a crushing plant in any situation where the product of the plant has an economic value that increases with decreasing particle size. As a typical example from which the utility and importance of the present invention will become readily apparent and which illustrates the complex problem that the invention solves, a crushing plant for mine-run iron ore may be operated in conjunction with a grinding mill to which ore must be fed in the form of particles that are below a specified size. Typically, the material fed to the grinding mill should be capable of passing a ½ inch (12.7 mm.) mesh screen. The mine-run material is processed through the crushing plant before being fed to the grinding mill in order to reduce the larger chunks and particles of the mine-run ore to grinding mill feed size.

It is well known that a crushing plant utilizes power more efficiently than a grinding mill. Thus, other things being equal, a crushing plant needs about half as much power as a grinding mill to reduce particle size by a given amount. Of course a crushing plant cannot reduce material to the very small and uniform particle size for which the grinding mill is needed, and therefore it is not possible to eliminate the grinding mill. But a crushing plant can turn out product in a range of particle sizes that can be fed to a grinding mill, and to the extent that product which is at or near the lower end of that range can be obtained from the crushing plant, the comminution work that is done by the more efficient crushing plant need not be done by the less efficient grinding mill, so that there is a net saving in the power needed to reduce the material to its ultimate particle size.

Heretofore it has not been known how to take advantage of the high comminuting efficiency of a crushing plant in order to obtain an economically optimum product. In fact, the operator of such a plant, who is usually assigned a quota of finished product for each working day or similar working period, often acted under the belief that he was achieving the greatest efficiency when he completed his quota within the shortest possible time and could thus conserve energy by shutting down the plant well before the end of the working day. Indeed, this theory of crushing plant economy has become so well established and so widely accepted that considerable ingenuity has been devoted to the provision of methods and apparatus for maximizing crushing plant tonnage per unit of time. See, for example, U.S. Pat. No. 3,480,212 to Liljegren et al, which discloses apparatus that is designed (according to the "Summary of Invention") to keep a crushing plant "operating at maximum tonnage by automatically checking certain operating conditions and thereafter automatically adjusting the set point of the automatic controller in the proper direction to obtain maximum feed rate for the existing conditions". Again, U.S. Pat. No. 3,078,051, to Patterson, discloses an automatically controlled crusher which, the patent says "produces a substantially constant tonnage per hour for a given horsepower consumed by the crusher. In this way the crusher produces a maximum tonnage output for the power consumed by the machine and hence operates at or near its peak efficiency for the material being crushed".

The present invention is based upon a recognition that there was a very serious fallacy in the reasoning whereby maximizing tonnage was set as the goal for crushing plant operation, in that such reasoning failed to take account of the economic value of the product of the crushing plant and therefore led to production of low value product. The more rational premise of the present invention is that a crushing plant is operated most profitably and most efficiently from the standpoint of both power consumption and capital utilization when its product is turned out at such a rate as to rather accurately meet a daily quota which is reasonable for the power available to the plant, and when, furthermore, the product has the highest economic value attainable within the constraints of the quota and the available power.

The invention further proceeds upon a recognition that the value of the product of a crushing plant is more or less directly related to the amount of energy that is expended by the plant in crushing a given quantity of the product, owing to a relationship between power expended and product particle size that is explained hereinafter.

These premises of the present invention are perhaps not new ideas in themselves, and their significance may have been appreciated in the past, but heretofore, considered in relation to one another, they have posed a baffling dilemma for the operator of a crushing plant. If he operated the plant in such a manner as to obtain a product of maximum economic value, he was likely to fall short of his production quota; and if he operated with his quota in mind, he could only follow the prior art teachings that set maximum tons per hour as the goal. The problem was aggravated by certain factors that greatly complicate the problem of controlling a crushing plant to achieve both quota fulfillment and optimum product value.

One of these complicating factors is the variable crushability of the material to be fed into the plant. Some pieces of material are more easily crushed than others, and a run of easily crushed material reduces the power required for crushing, or speeds up the throughput of the plant, or both.

Another complicating factor is the wide variation in size of the input material particles. For material of a given crushability, power required for crushing is a function of reduction ratio which is the ratio of the size of uncrushed particles to crushed particles. Other factors also bear upon the power required, but, in general, less power is required to crush small particles to a given final size than to crush large ones to the same final size. Therefore, assuming a constant power application and that both large and small particles are crushed to the same final size, a quantity of raw material consisting mostly of small particles can be crushed more rapidly than one containing mostly large particles.

Another complicating factor is that the mine-run infeed material enters the crushing plant at a separating zone where the smallest particles are separated from the remainder of the material and from which they are transferred directly to a delivery zone in bypassing relation to the crushing mechanism. Since the separated fine material must be considered as a part of the production of the plant that contributes to fulfilling its quota, optimizing production requires that the full available power of the plant be applied to the larger size remainder of the material and that exactly so much of that material is put through the plant during the day as will, together with the unpredictable volume of fines that have bypassed the crushing mechanism, make up the day's quota.

There are other complicating factors, some of which may be unknown, inasmuch as no mathematical model has been found that accurately states the relationship between rate of production and power required at any given time. Nevertheless, in the operation of a crushing plant in accordance with the method of this invention, that varying and unpredictable relationship is constantly taken into account in a very simple manner.

From what has been said above, it will be apparent that the general object of this invention is to provide a method of so controlling operation of a crushing plant that the output of the plant will consistently be substantially equal to a daily quota established on the basis of an assessment of the reasonable capabilities of the plant and, in addition, that its product will have the optimum economic value attainable with the expenditure of all of the power available to the plant, having in mind that the economic value of a given quantity of crushing plant product increases with increase in the power expended to produce that quantity of product.

In the most general terms, the object of the present invention is conservation of energy, as will be apparent when the invention is considered in relation to a crushing plant which feeds into a grinding mill, in which case the invention has as its object the processing of any given amount of material through the entire complex comprising the plant and the mill with a minimum expenditure of energy for the total processing.

Still speaking very generally, it is also an important object of this invention to provide a method of so controlling the operation of a mineral crushing plant as to achieve optimum utilization of the capital invested in the plant.

Another and more specific object of this invention is to provide a method for so controlling the operation of a crushing plant that an assigned production quota will be met by it at the end of each working day or similar working period, notwithstanding constant variation in crushability and size of the raw material fed into the plant and the varying rates at which product-size fines are bypassed around the crushing mechanism.

It is also a specific object of this invention to provide a method and process whereby a crushing plant may be controlled to achieve the several objects set forth above, either with the employment of manual controls, or with fully automatic controls that can be relatively simple and inexpensive, or with a combination of manual and automatic controls.

Inasmuch as recirculation of material in a crushing plant is inefficient in consuming power for mere transportation of material within the plant and in requiring the presence of expensive screening and classifying equipment for the recirculated loads, it is another specific object of this invention, realized in certain modes thereof, to provide a method of so operating a crushing plant as to minimize or avoid recirculation of materials while at the same time attaining the objectives set forth above.

BRIEF SUMMARY OF THE INVENTION

In general, the invention achieves its several objects because it is based upon an assignment of the proper priorities to quota and to quality, respectively. According to the invention, first priority is given to producing the daily quota—and neither substantially more nor substantially less than that quota—and to that end the rate of production is adjusted from time to time to afford reasonable assurance that the quota will be fulfilled and that the entire production day will be expended in fulfilling it. With the production rate thus tied to the quota requirement, the operation of the plant is further so controlled, in a known manner, that the full available power of the plant is constantly expended in the crushing of material that is being processed through the crushing mechanism. In this way assurance is had that the maximum possible amount of power will have been expended in producing each day's output, and that consequently the product turned out each day will have the highest attainable economic value.

More specifically, the objects of the invention are achieved with a crushing plant comprising one or more crushing mechanisms and having a product delivery zone to which all material passed through the plant is delivered by controlling the operation of the plant in accordance with the method of this invention, which is characterized by: ascertaining at each of several measurement times during the course of a working period such as a working day, the quantity of product delivered to the delivery zone since the beginning of the working period, and, on the basis of the quantity so ascertained and the amount of material still to be delivered to the delivery zone to meet a predetermined quota for the working period, changing the rate of feed of raw material to the crushing mechanism as necessary to enable the quota to be fulfilled at the end of the working day; and in a known manner controlling the crushing mechanism to cause material being fed thereto to be processed therethrough at substantially the same rate that the material is fed in, and to cause the crushing mechanism to constantly draw the full amount of power available to it. The crushing mechanism can be controlled to draw the full power available to it in any known manner, as by adjustment of that mechanism for coarser or finer output, by recycling varying proportions of material back through the crushing mechanism, or in a multiple-stage crushing plant or a crushing plant having plural crushers, by controlling the relative rates at which input material is fed to the respective stages or crushers.

With these observations and objectives in mind, the manner in which the invention achieves its purpose will be appreciated from the following description and the accompanying drawings, which exemplify the invention, it being understood that changes may be made in the preferred mode of practicing the invention that is disclosed herein without departing from the essentials of the invention as set forth in the appended claims.

The accompanying drawings illustrate several complete examples of practice of the invention according to the best modes so far devised for the practical application of the principles thereof, and in which:

DESCRIPTION OF THE PREFERRED MODE

Figure 1:
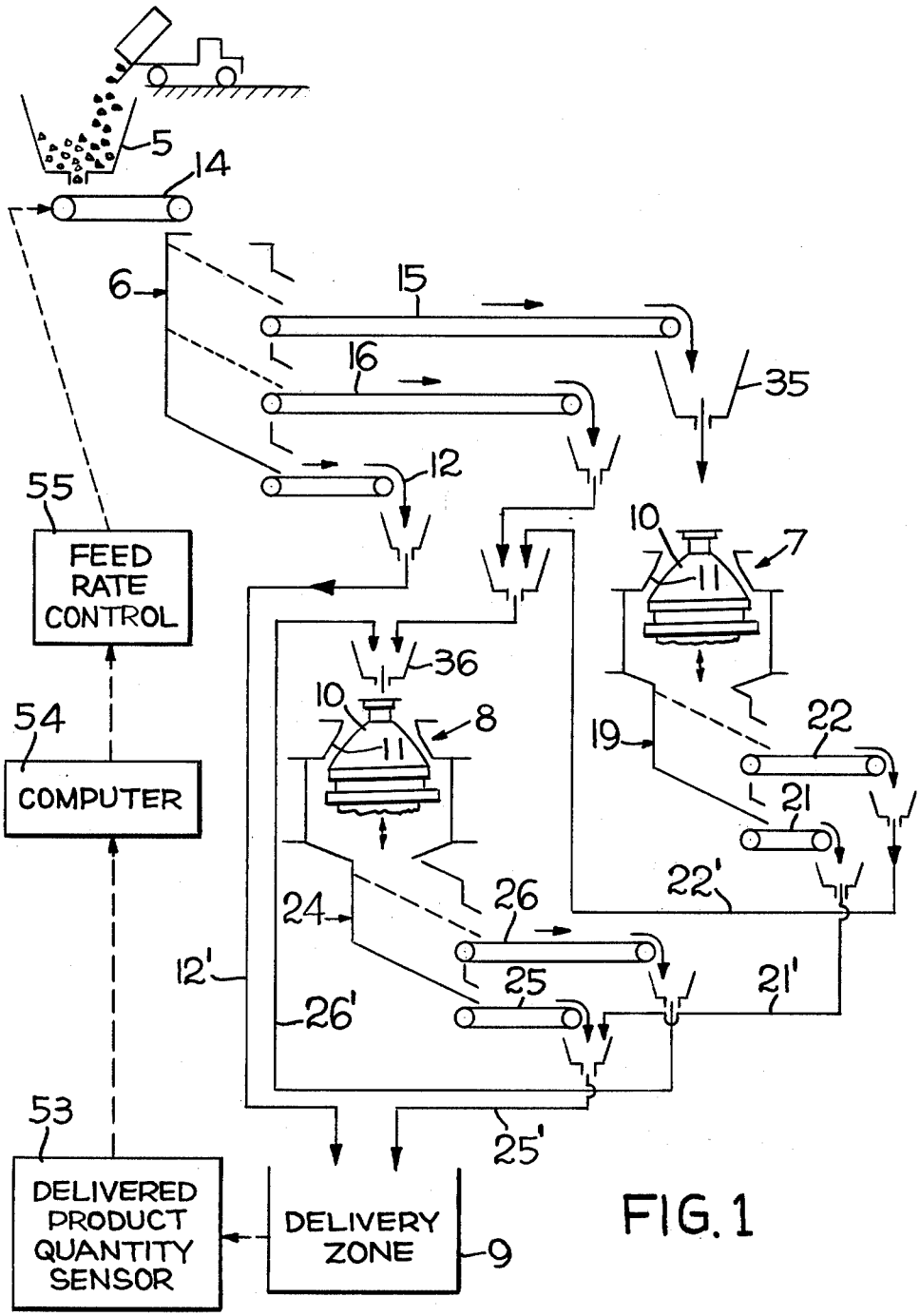
FIG. 1 is a more or less diagrammatic view illustrating flow of material through a processing plant controlled in accordance with the principles of this invention.

The plant that is illustrated more of less diagrammatically in FIG. 1 is a two-stage crushing plant that comprises a holding bin 5 to which mine-run raw material is delivered to be fed into the plant, a classifier or separating means 6 at which the material is sorted according to particle size, crushing mechanism illustrated as comprising a primary crusher 7 and a secondary crusher 8, and means defining a delivery zone 9 to which the plant delivers finished product. Although a three-stage crushing plant is perhaps more commonly used in connection with mining operations, explanation of the invention is simplified by reference to a two-stage plant, and those skilled in the art will readily understand from that explanation how the method of this invention can be applied to the operation of other multi-stage crushing plants as well as single-stage plants.

In this case, for simplicity, single primary and secondary crushers 7 and 8 are illustrated, but it will be understood that each of these can be regarded as representing plural crushers operating in parallel. Every crusher is preferably of a type that can be adjusted while in operation to produce (other things being equal) a finer or a coarser product. Cone crushers are illustrated by way of example, each having a power driven gyratory cone 10 that cooperates with a relatively stationary crusher ring 11, the cone and ring being adjustable in relation to one another to provide a variable spacing between them (called crusher setting) for control of product particle size. Typically, each of the crushers can be a HYDRO-CONE (trademark) crusher manufactured by the Allis-Chalmers Corporation.

At the classifier or separating means 6 to which incoming material is fed, all particles of the material that are of predetermined product size (e.g., smaller than ½ inch or 12.7 mm) are separated from the remainder of the material and are transferred directly to the delivery zone 9 in bypassing relation to the crushing mechanism, as designated by the flow path 12, 12', which represents suitable conveyor means. Transfer of product-size material directly to the delivery zone is generally conventional in the operation of crushing plants. However, it is emphasized that the classifier 6, as well as other grading screens and the like in the crushing plant, should be as efficient as possible, so that substantially all material that is small enough to pass through a screen or other classifier will do so. This is pointed out because it is believed that crushing plant classifying devices are too often inefficient by reason of insufficient area, whereas it is essential to efficient power utilization in a crushing plant that all of its classifying screens and the like be of adequate size to ensure a complete separation of the materials intended to be separated. If, for example, a substantial amount of product-size material is allowed to be fed to a secondary crusher or recirculated through it, power may be wasted both in the transportation of such material and in ineffectually passing it through the crusher.

After product-size material is separated out, the remainder of the mine-run material is of course passed through the crushing mechanism. However, before it is crushed, and while such material is still at the separating means 6, it may be further separated in accordance with conventional practice. Thus, in the case of the illustrated two-stage plant, the separating means 6 can be a three-stage classifier that separates incoming material of larger than product size into largest chunks that are to be fed to the primary crusher 7 and intermediate size particles that are suitable for feeding to the secondary crusher 8.

The mine-run material that is put through the separating means 6 is delivered to it from the feed bin 5 by means of variable rate feed mechanism illustrated as comprising a conveyor 14; and from the separating means the material of larger than product size is fed into the crushing mechanism 7, 8 by other feed mechanism, illustrated as comprising a conveyor 15 that carries the largest pieces to the primary crusher 7 and a conveyor 16 that carries intermediate size pieces to the secondary crusher 8.

The material that has been put through the primary crusher 7 passes through a secondary separating means 19 at which product size particles are separated from pieces that are of a size to warrent passage through the secondary crusher 8. The product size particles are transferred from the secondary separating means 19 directly to the delivery zone 9 by conveyor means 21, 21' or the like, and the larger pieces are transported from the secondary separating means to the secondary crusher 8 as by conveyor means 22, 22'. It will be understood that the secondary separating means 19 could be a three-stage classifier, instead of a two stage one as shown, and that provision could then be made for recirculation back to the primary crusher 7 of the largest size pieces issuing from it.

There may be a tertiary separating means 24 at which the output of the secondary crusher 8 is received and by which product size particles are delivered to the delivery zone, as by conveyor means 25, 25', while larger particles are recirculated back to the inlet of the secondary crusher, as by conveyor means 26, 26', or are fed to some other crusher in the plant.

It is important for purposes of the method of this invention that the feed means by which incoming material is fed into the crushing mechanism be controllably variable as to feed rate. In this case the controllable rate feed means is illustrated as comprising an adjustable speed conveyor 14, but the particular means for controllably varying the feed rate is not significant, and various satisfactory expedients for that purpose are well known.

According to the method of this invention, the rate of feed of material into the plant is so adjusted from time to time that the rate of delivery of product material to the delivery zone 9 always approximates an ideal rate at which maintenance of steady production through the working day or other working period will result in substantially exact fulfillment of a predetermined quota for the period.

It will be understood that the quota that is predetermined for each working period should be one that is realistically within the capabilities of the crushing plant for production of economically optimum output. Since the material to be processed normally varies from day to day, the quota for each working period can be established on the basis of an analysis of the material to be handled during the working period, and as experience is gained such quotas will have an increasingly accurate relationship to the capacity of the plant.

Of course the actual rate of production will seldom equal the ideal rate, and therefore adjustments are made to the feed rate at each of a number of measurement times during the working period. At each such measurement time a determination is made, as by means of a suitable sensor 53, of the quantity of material that has been delivered to the delivery zone 9 from the beginning of the working period to the particular measurement time. Such determinations can be made in any known manner, as by weighing the total quantity of product at the delivery zone at each measurement time, by totalizing the running weights of product-size material delivered from the separating means 6 and from the several individual crushers to the delivery zone, or by measuring a quantity which bears a consistent relationship to weight of produced material such as volume of material at the delivery zone in a case where density of the product is reasonably constant.

Figure 2:
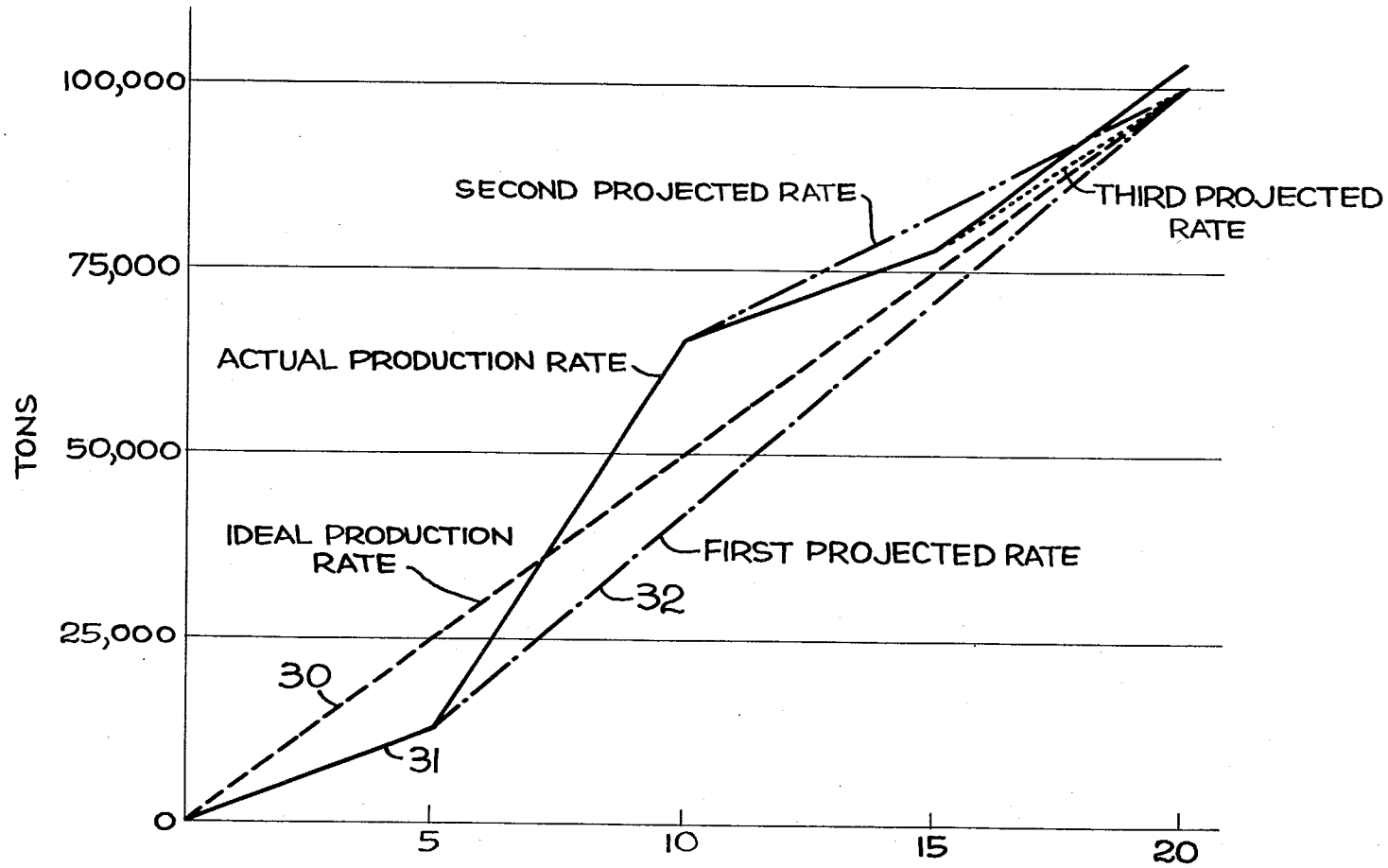
FIG. 2 is a graph depicting how feed rate to a crushing plant is controlled in accordance with the principles of this invention.

For purposes of simplification, FIG. 2 illustrates a case in which measurements are taken only four times, at five-hour intervals, during a typical 20-hour working period; but it will be understood that measurements of product delivered are preferably made at substantially more frequent intervals. It is preferable but not necessary that the measurement times occur at uniform intervals.

At each measurement time the amount of material actually produced from the beginning of the working period to that time is compared with the theoretical amount that would have had to be produced up to that time in order to make good the quota at the end of the day on the assumption of production at a steady, constant rate. As shown in FIG. 1, that comparison is made by means of a computer 54 that receives inputs from the sensor 53. In FIG. 2, the quota for a 20-hour day is shown as 100,000 tons and the slope of the broken line 30 denotes the ideal steady rate of production that would have to be maintained constantly through the day in order to fulfill that quota, the illustrated ideal rate being 5,000 tons per hour. As illustrated, the measurement made at the fifth hour of the day shows that only 12,500 tons were produced during the first five hours of the day, and hence the rate of production, denoted by the slope of the solid line 31, has been 2,500 tons per hour, which is substantially lower than the ideal rate during that five-hour interval. To produce exactly the quota quantity at a steady rate of production through the remainder of the day, production during the remaining 15 hours would have to be 87,500 tons (100,000 minus 12,500), for a production rate of 5,833 tons per hour, the rate denoted by the slope of the dot-dash line 32. The rate of feed to the crushing plant will be increased accordingly, as by an upward adjustment of the speed of conveyor 14. By reference to the feed rate prevailing during the period ending at the first measurement time and the results obtained with that feed rate, it will be apparent that the feed rate after the fifth hour will theoretically have to be increased to 125% of the feed rate before the fifth hour in order to make good the quota. (It will be appreciated that exaggerated values are used in this illustration for purposes of clarity.) As shown in FIG. 1, the rate of feed of the feed device comprising conveyor 14 is adjusted by means of an automatic feed rate control device 55 connected with the computer 54.

Continuing with the example illustrated in FIG. 2, it is assumed that at the end of the tenth hour, at the second measurement time, total production for the first ten hours is found to be 65,000 tons, whereas at the ideal production rate 50,000 tons would have been produced up to that measurement time. The amount remaining to be produced for the day is 45,000 tons, with a theoretical production rate of 4,500 tons per hour; whereas actual production during the interval from the first measurement time to the tenth hour was at the rate of 10,500 tons per hour, so that the rate of feed to the plant must now be reduced to about 43% of what it had been between the first and the second measurement times.

A third production measurement is taken at the fifteenth hour (the third measurement time) and the rate of feed to the plant is adjusted in the same manner as before. At the end of the illustrative 20-hour working day, actual production is shown as being a few thousand tons above the quota value. Realistically, owing to the method of control of feed rate by successive approximations, it may not be possible in every case to achieve exactly the production quota with absolute precision, but it will be appreciated that the "miss" is exaggerated in this case, consistently with exaggeration of departure of actual production rate from real production rate, and that with sufficiently frequent measurement times, the "miss," if there is one, will be small. It is to be borne in mind that the quota does not represent a quantity that must be produced with exactitude, and in fact there will ordinarily be no practical need for precise attainment of the quota. In its primary function the quota represents a more or less theoretical value, in that it is selected for purposes of quality control; but its meaning is not purely theoretical because it does designate the approximate quantity that will be produced during the working period.

With the rate of feed to the crushing plant controlled as described above, to assure that substantially the quota quantity of product is delivered to the delivery zone 9 at the end of the working period, it is further necessary to so control the crushing mechanism 7, 8 as to ensure that the full power available to it is applied all during the period. Methods for so controlling applied power are generally known.

In the simplest case, with a single crusher that can be adjusted while in operation for controlling the size of output material, the crusher adjustment can be varied as necessary to cause the crusher to draw its full available power at all times and thus cause its output to be in the smallest particles that can be achieved with the available power and within the constraint imposed by the feed rate. A system for controlling crushers by such adjustment is disclosed in U.S. Pat. No. 3,117,734 to J. P. McCarty et al, which points out that various expedients can be utilized to sense the instantaneous power consumption of a crusher, and mentions thermo-converter sensing devices and pressure sensing devices as examples. The McCarty et al patent further teaches that instead of the therein-preferred maintenance of constant power input by control of feed rate, "alternatively the position of the cone or crusher setting can be modified instead of the feed rate to maintain the desired crusher loading or efficiency." In applying the teachings of McCarthy et al to the method of the present invention, this alternative would of course be employed.

It is well known that the power drawn by an individual crusher can be controlled to a substantial extent by controlling the rate at which material is fed into the crusher. Hence the control method of this invention can be employed in a plural crusher crushing plant that has crushers which are not adjustable, or which cannot be adjusted while they are operating, if feed is so apportioned among the several crushers as to maintain the power drawn by each constantly at its maximum available value. Such feed apportionment is generally in accordance with the teachings of the above-mentioned McCarty et al patent. However, the teachings of that patent must be modified to adapt them to the method of the present invention, wherein the rate of feed to the crushing mechanism as a whole is controlled as explained above, and adjustment of the rate of feed to any one crusher will therefore affect the rate of feed to one or more other crushers. Hence, where feed rates to individual crushers are adjusted to maintain constant maximum power draw for each, it is necessary that a balance be maintained among the feed rates to individual crushers in order to ensure that every one of them is drawing its maximum available power even as the plant as a whole is processing material at substantially the rate at which material is being fed into the crushing mechanism as a whole. Although the control of feed rates to individual crushers as hereinafter described is necessary in plants that have crushers which are not adjustable in operation, it can also be employed advantageously where all crushers have provision for such adjustment; and in the latter case the crushing plant has a versatility that enables it to turn out an economically optimum product even under unusual conditions.

Figure 3:
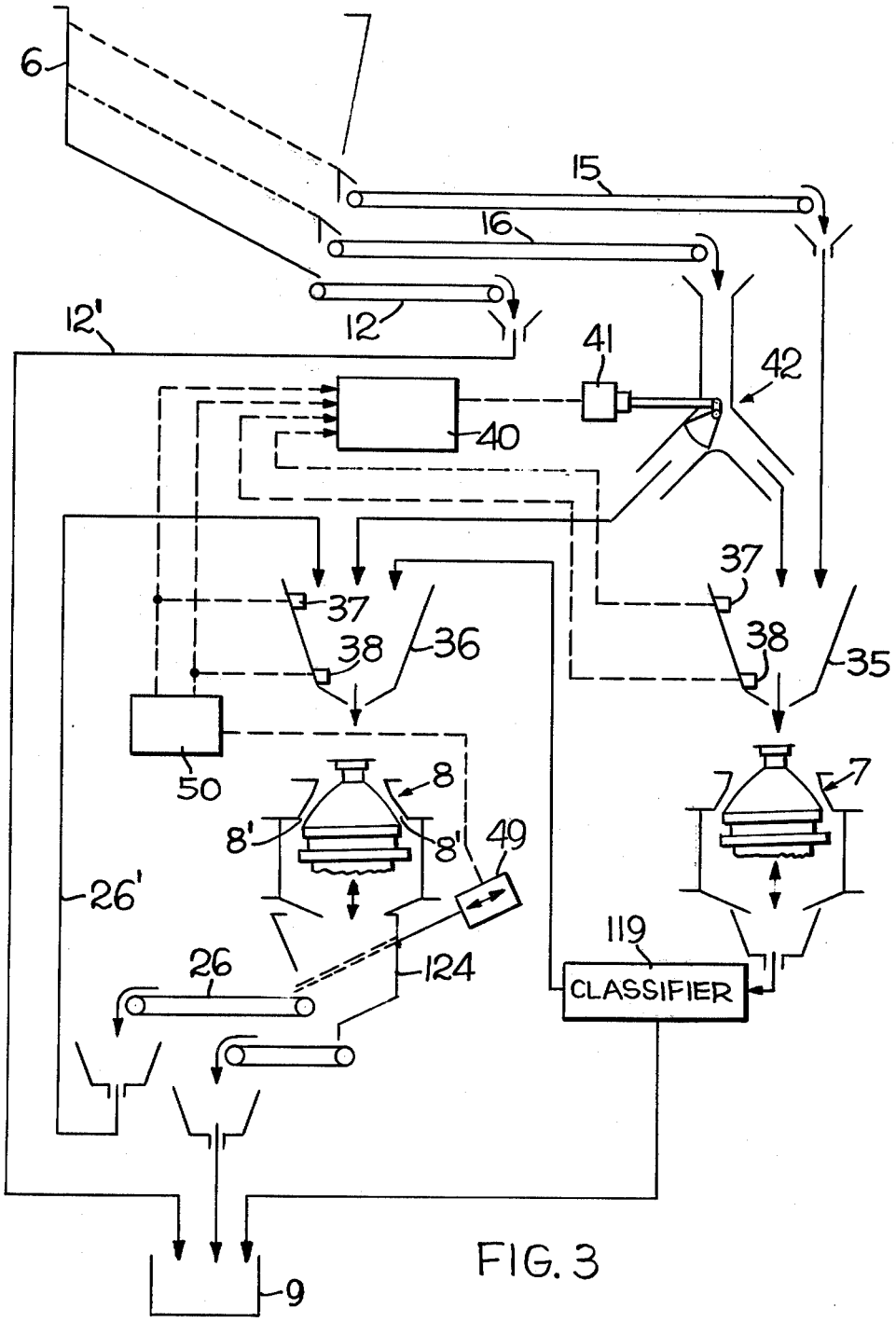
FIG. 3 is a diagrammatic view generally similar to a portion of FIG. 1 but illustrating a modified practice of the invention.

For the purpose of balancing the various individual crusher feed rates in relation to one another, it is necessary that there be some means for sensing the relationship between the prevailing feed rate to each individual crusher and the rate at which the crusher can process the materials being fed to it while consuming all of its available power. One known expedient for sensing that relationship is illustrated in FIG. 1, wherein a surge bin 35, 36 is provided for each of the respective crushers 7, 8, and material is fed to each crusher through its surge bin. Each surge bin, as illustrated in FIG. 3, has sensing means 37 for detecting a predetermined maximum level, and it preferably also has sensing means 38 for detecting a predetermined minimum level. If material in a surge bin rises to the predetermined maximum level, the maximum level sensing means 37 produces a signal that terminates feed of material into the surge bin, or substantially slows such feed, until material in the bin falls below the predetermined maximum level. Conversely, if the level of material in a surge bin falls below the minimum, the sensor 38 produces a signal that causes a recommencement or acceleration of feed into the surge bin.

Either or both of the two expedients now to be described can be employed for utilizing signals from the several surge bin sensors to control feed to the individual surge bins.

In the simplified system which is shown in FIG. 3, signals from the level sensors 37, 38 for each of the surge bins 35 and 36 are supplied to a control device 40 that can comprise comparators, logic circuits and the like. Details of the control device 40 are not shown because the nature of the device will be apparent to those skilled in the art. The control device, in turn, issues signals to a servo 41 that controls the position of a flow divider 42. The flow divider, which is in the nature of a proportioning valve, is arranged to control distribution, as between the primary and the secondary crusher, of intermediate size feed material that issues from the primary separating means 6 by way of the conveyor 16, such material being suitable for feed to either of the crushers 7 or 8. Thus, for example, if the surge bin 36 for the secondary crusher is full, or nearly full, the flow divider will be so adjusted that intermediate size material will be mainly or solely fed to the surge bin 35 for the primary crusher 7.

U.S. Pat. No. 3,117,734 to McCarty et al. discloses another type of flow divider suitable for crushing plants, shown in that patent as employed to proportion the rates at which a pair of secondary crushers are fed. Those skilled in the art will readily understand how the principles of that flow divider and its control mechanism can be appropriately modified to adapt it for employment in the method of the present invention.

Figure 5:
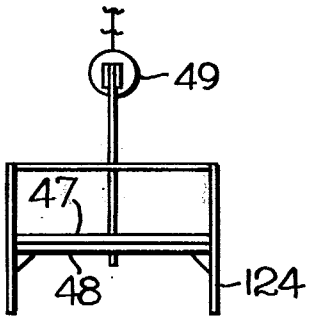
FIG. 5 is an end view of the adjustable classifier shown in FIG. 4 with parts broken away.
Figure 4:
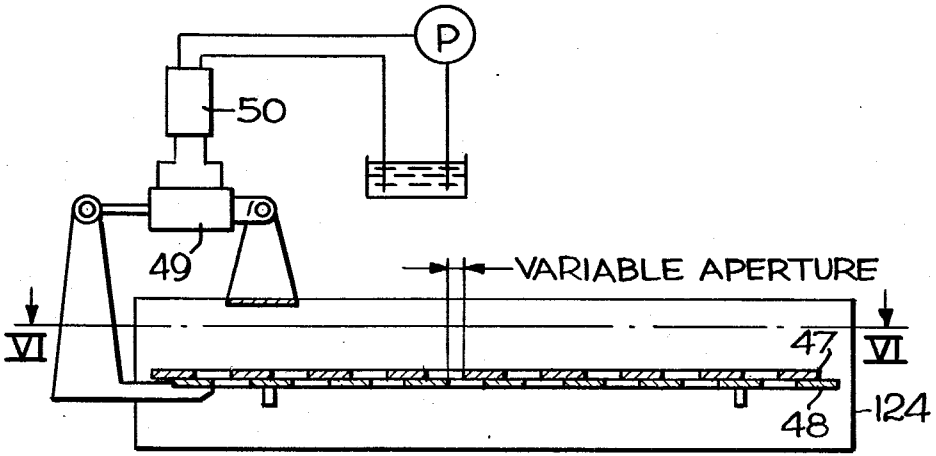
FIG. 4 is a view taken on the plane of the line IV—IV in FIG. 6, showing the essential elements of an adjustable classifier that is useful in connection with certain modes of practice of the method of this invention.
Figure 6:
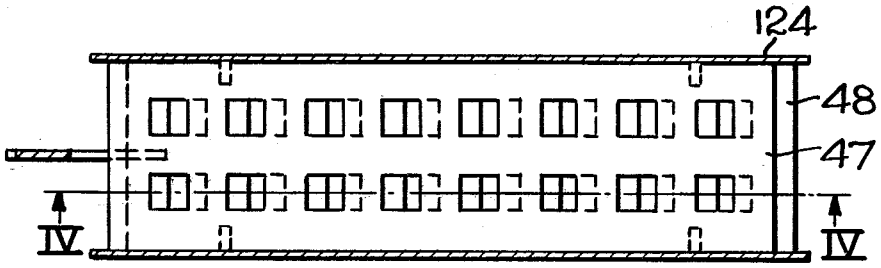
FIG. 6 is a top view taken on the plane of line VI—VI in FIG. 4.

Another expedient for balancing feed rates among individual crushers, capable of being employed either alone or in combination with the adjustable flow divider 42, is an adjustable classifier 124 such as is illustrated more or less diagrammatically in FIGS. 4, 5, and 6. FIG. 3, for simplicity, shows the adjustable classifier 124 cooperating with recirculating means 26, 26' by which a varying portion of the material that has issued from the outlet 8' of the secondary crusher 8 is fed back to that crusher through its inlet surge bin 36. The classifier 119 that receives material from the output of the primary crusher 7 can also be adjustable, or only the classifier 119 might be adjustable and not the classifier 124.

As illustrated more or less schematically in FIGS. 4, 5 and 6, the adjustable separating device 124 can comprise a fixed screen 47 and an adjustable movable screen 48 that closely underlies the fixed screen. The two screens 47 and 48 have identical patterns of holes. When the movable screen 48 is in a position in which its holes fully register with those of the fixed screen, relatively large particles drop through the screen combination, whereas shifting the bottom screen away from that position progressively decreases the size of the particles that can drop through. Thus, considering the illustrative apparatus shown in FIG. 3, if the surge bin 36 for the secondary crusher 8 is tending to empty, and the primary crusher is operating in such a manner that adjustment of the flow divider 42 is undesirable or impractical, the adjustable separating device 124 can be closed down to send less of the secondary crusher output to the delivery zone and recirculate the increased remainder of that output back through the secondary crusher. It will be understood that the position of the movable screen in the separating device 124 can be adjusted by means of a suitable servo mechanism 49, operating in response to signals from a control device 50 that may comprise a part of the master control device 40 and receives signals from surge bin sensors 37, 38. If circulating loads in the plant rise to a substantially high level, due for example to a run of unusually hard material, the movable screen 48 can be adjusted either manually or automatically to permit a coarser product to be transferred to the delivery zone and thus cause less of the power available to the plant to be wasted in mere recirculation.

It will be apparent that an adjustable separating device could be arranged as at 119 in FIG. 3 to receive material from the primary crusher 7 and to cooperate with suitable conveyors and the like (not shown) to recirculate a varying portion of the primary crusher output back to the primary crusher while the remainder is sent to the secondary crusher. Alternatively, a flow divider similar to the flow divider 42 could be arranged to cooperate with a fixed-setting separating device that receives the output of the primary crusher 7 and apportions that output as between a recirculating conveyor that returns to the primary crusher the coarsest part of its output and a transfer conveyor that carries the remainder of that coarsest output to the secondary crusher. These obvious combinations and permutations of the above explained expedients are not illustrated because they and other such combinations and permutations will readily suggest themselves to those skilled in the art. Furthermore, from the known art relating to control of crushers and crushing plants, various modifications of the above explained expedients for causing every crusher to draw its full available power constantly, and other expedients and combinations of expedients for the same purpose, will readily suggest themselves.

It will be apparent that control of a simple crushing plant can be effected manually in accordance with the principles of this invention, provided that the plant is equipped with adequate means for ascertaining total quantity of product arriving at the delivery zone from the beginning of the working period until each measurement time, for sensing power drawn by each crusher, and for presenting signals to the operator in accordance with the sensed values. In most cases, however, it will be preferable to employ computer means to perform the necessary monitoring and control functions, and it will be apparent that neither the computer nor the program for it need to be expensive for very satisfactory results to be obtained.

From the foregoing description taken with the accompanying drawings it will be apparent that this invention provides a method of controlling a crushing plant whereby assurance will be had that the plant will produce a predetermined quota of product material at the end of each working day or other working period and whereby the product material will have the optimum economic value attainable within the constraints of the quota and the power available for the plant.

Those skilled in the art will appreciate that the invention can be embodied in forms other than as herein disclosed for purposes of illustration.

The invention is defined by the following claims:

I claim:

1. A method of controlling operation of a crushing plant having a crushing mechanism (7 and 8) for which a predetermined amount of power is constantly available, means (14) for feeding raw material to the crushing mechanism (7 and 8) at a controllably variable feed rate, and a delivery zone (9) to which product material of less than a predetermined particle size is delivered, said method enabling a predetermined quantity of product material to be delivered to the delivery zone (9) during a predetermined working period while also ensuring that the product material delivered to said zone (9) during said period is of optimum economic value by reason of having the smallest particle size attainable within the constraints imposed by said predetermined quantity and the available power, said method being characterized by:

A. at each of a plurality of measurement times during the working period
  (1) ascertaining the quantity of material that has been delivered to the delivery zone (9) from the beginning of the working period to the measurement time, and
  (2) by reference to
    (a) the amount of material that still needs to be delivered to the delivery zone (9) to make up said predetermined quantity,
    (b) the time remaining from the measurement time to the end of the working period, and
    (c) the rate at which raw material was being fed to the crushing mechanism (7,8) during an interval immediately preceding the measurement time,
    adjusting the rate of feed (at 14) of raw material to the crushing mechanism (7,8) to a value which, if maintained to the end of the working period, is calculated to cause said predetermined quantity of material to have arrived at the delivery zone (9) by the end of the working period; and B. at all times so controlling the crushing mechanism (7,8) as to cause it to consume the full amount of power available to it while it continues to process material at substantially the prevailing feed rate.

2. The method of claim 1 wherein the crushing mechanism (7,8) comprises a crusher (7 or 8) having a setting (10,11) that is variable while the crusher is in operation to vary the crushing force exerted on particles of a given size, and wherein control of the crushing mechanism to constantly consume the full amount of power available to it is characterized by:

adjusting the crusher setting.

3. The method of claim 1 wherein said crushing mechanism comprises a pair of crushers (7,8), only one of which (7) can be fed largest size particles and both of which can be fed particles that are smaller than said largest size, and wherein control of said crushing mechanism to constantly consume the full amount of power available to it is characterized by:

so apportioning (as, e.g., by 42) between said crushers particles that are smaller than said largest size as to maintain the feed rate to each of said crushers at a value which requires each crusher to consume the full amount of power available to it.

4. The method of claim 3 wherein particles that are smaller than said largest size are apportioned between said crushers by:

(1) separating and feeding to the other of said pair of crushers substantially only such of said smaller than largest size particles as are within an adjustably variable range of sizes, and
(2) increasing or decreasing said range (as by 48,49) in accordance with the need for increased or decreased rate of feed to said other crusher.

5. The method of claim 1 wherein the crushing mechanism (7,8) comprises a crusher (8) having an inlet and an outlet and further comprises recirculating means (26,26') for feeding material that has issued from said outlet (8') back to said inlet (36), and wherein control of the crusher to consume the full amount of power available to it is characterized by:

so apportioning material that has issued from said outlet (8') between said recirculating means (26,26') and means (25) for delivering material to another destination (e.g., 9) in the crushing plant, that the feed of material back to said inlet (36) from said outlet (8'), together with the feed of other material (from 7 and/or 42) into said inlet (36), maintains a feed rate for said crusher (8) that causes it to consume the full amount of power available to it.

6. The method of claim 5 wherein apportionment of material as between said recirculating means (26,26') and said means (25) for delivering material to another destination (e.g., 9) is characterized by:

(1) separating from all of the material issuing from said outlet (8') substantially all particles thereof that are within a predetermined but variable range of larger particle sizes;

(2) delivering the particles within said range to the recirculating means (26,26') and the remainder to said means (25) for delivering material to another destination (e.g., 9); and (3) increasing and decreasing said range (by 49) in correspondence with the need for increasing and decreasing, respectively, the rate at which material is fed back to said inlet (36).

7. A method of controlling operation of a crushing plant comprising a crushing mechanism (7,8) for which a predetermined amount of power is constantly available, means (14) for feeding raw material to the crushing mechanism (7,8) at a controllably variable feed rate, and a delivery zone (9) to which product material of less than a predetermined particle size is delivered, said method enabling a predetermined quantity of product material to be delivered to the delivery zone (9) during a predetermined working period while also ensuring that the product material delivered to said zone during said period is of optimum economic value by reason of having the smallest particle size attainable within the constraints imposed by said predetermined quantity and the available power, said method being characterized by:

A. at least at each of a plurality of predetermined measurement times during the working period, measuring a function of quantity of material already delivered to the delivery zone;

B. at each measurement time, by reference to said measured function, ascertaining the amount of material still to be delivered to the delivery zone during the remainder of the working period to make up said predetermined quantity;

C. at each measurement time, ascertaining the projected rate at which material must be delivered to the delivery zone in order to deliver thereto, during the portion of working period that follows the measurement time, said amount of material still to be delivered;

D. at each measurement time adjusting the rate of feed (at 14) to the crushing mechanism (7,8) in correspondence with the relationship between said projected rate and the rate of feed prevailing during an interval immediately preceding the measurement time; and E. at all times so controlling the crushing mechanism as to cause it to consume the full amount of power available to it while it continues to process material at substantially the prevailing feed rate.

8. A method of controlling operation of a crushing plant having a crushing mechanism (7,8) for which a predetermined amount of power is constantly available, a delivery zone (9) to which product material of less than a predetermined particle size is delivered, separating means (6) ahead of the crushing mechanism (7,8) at which raw material in a wide range of particle sizes is received and by which product-size material is removed from received raw material, means (12,12') for transferring removed product-size material from the separating means (6) to the delivery zone (9) in bypassing relation to the crushing mechanism, and feeding means (15,16) for feeding the remainder of the received raw material at a controllably variable feed rate from the separating means to the crushing mechanism (7,8) to be reduced to product-size material and then delivered to the delivery zone (9), said method enabling a predetermined quantity of product-size material to be delivered to the delivery zone (9) during a predetermined working period while also ensuring that the delivered product material is of optimum economic value by reason of its small particle size, said method being characterized by:

A. at each of a plurality of measurement times during the working period, (1) determining the amount of material that had been delivered to the delivery zone during the interval from the beginning of the working period to the measurement time, and (2) so adjusting the rate of feed of raw material (at 14) to the crushing mechanism, by reference to (a) the amount of product still to be delivered to the delivery zone to make up said predetermined quantity, (b) the time remaining until the end of the working period, and (c) the rate at which raw material was being fed to the crushing mechanism during an interval immediately preceding the measuring time, that the adjusted feed rate (from 14) will be such as to enable said predetermined quantity of product to have arrived at the delivery zone (9) at the end of the working period assuming that fine material continues to be bypassed (via 12, 12') around the crushing mechanism (7,8) at the rate prevailing during said interval immediately preceding the measuring time; and B. at all times so controlling the crushing mechanism as to cause it to constantly consume the full amount of power available to it.

9. A crushing plant comprising crushing mechanism for which a predetermined amount of power is constantly available, feed means for feeding raw material to the crushing mechanism, and means defining a delivery zone to which product material of less than a predetermined particle size is delivered, said crushing plant being characterized by:

A. said feed means being constructed and arranged to feed raw material to the crushing plant at a controllably variable rate;

B. sensing means responsive to a function of quantity of material delivered to the delivery zone and arranged to produce an output at each of a plurality of predetermined measurement times during a working period, which output corresponds to the amount of material delivered to the delivery zone from the beginning of the working period to the measurement time;

C. computer means connected with said sensing means and programmed with information relating to the quantity of material that should have been delivered to the delivery zone, from the beginning of the working period to each measurement time, in order for a predetermined quota quantity of material to be delivered to the delivery zone at the end of the working period;

D. feed rate control means operatively connected with said feed means and responsive to outputs from said computer means for so adjusting the rate of feed of raw material at each measurement time as to compensate for differences between the amount of material actually delivered to the delivery zone up to each measurement time and said programmed quantity of material that should have been delivered; and E. means for at all times so controlling the crushing mechanism as to cause it to consume the full amount of power available to it while it continues to process material at substantially the prevailing feed rate.

10. The crushing plant of claim 9 wherein said crushing mechanism comprises a crusher having an inlet and means for recirculating material that has passed through the crusher back to said inlet, further characterized by:

said means for controlling the crushing mechanism comprising means for so apportioning material recirculated to said inlet by said recirculating means and material fed to said crusher from elsewhere in the crushing plant as to maintain the feed rate to the crusher such that it will consume the full amount of power available to it.

11. The crushing plant of claim 9 wherein said crushing mechanism comprises a pair of crushers, only one of which can be fed largest size particles and both of which can be fed particles that are smaller than said largest size, further characterized by:

said means for controlling the crushing mechanism comprising means for so apportioning as between said crushers particles that are smaller than said largest size as to maintain the feed rate to each of said crushers at a value which requires the crusher to consume the full amount of power available to it.

* * * * *